United States Patent [19]

Spears

[11] 4,096,829

[45] Jun. 27, 1978

[54] WATER INJECTION SYSTEM FOR INTERNAL COMBUSTION ENGINES

[76] Inventor: George B. Spears, 8634 Franklin Ave., Los Angeles, Calif. 90069

[21] Appl. No.: 681,418

[22] Filed: Apr. 29, 1976

[51] Int. Cl.[2] ..... F02D 19/12

[52] U.S. Cl. ..... 123/25 J; 123/25 L; 123/198 A

[58] Field of Search ..... 123/25 R, 25 J, 25 R, 123/25 L, 25 M, 25 N, 198 A; 261/18 A

[56] References Cited

U.S. PATENT DOCUMENTS

| | | | |
|---|---|---|---|
| 2,667,148 | 1/1954 | Blanchard | 123/25 R |
| 3,490,422 | 1/1970 | Bullis | 123/25 R |
| 3,631,843 | 1/1972 | Yeiser | 123/25 M X |
| 3,871,343 | 3/1975 | Nagai et al. | 123/25 R X |
| 3,911,871 | 10/1975 | Williams et al. | 123/25 M X |

*Primary Examiner*—Charles J. Myhre
*Assistant Examiner*—Ira S. Lazarus
*Attorney, Agent, or Firm*—William W. Haefliger

[57] ABSTRACT

Liquid injection apparatus for use with an internal combustion engine having an ignition system comprises:

a. a liquid pump and electrical drive therefor, the pump having an outlet communicable with the engine air intake, b. and control means including a pulse rate frequency to analog converter to control electrical current flow to the drive in response to and as a function of electrical pulses produced by said ignition system, whereby the flow of liquid to the engine air intake will be a function of the pulse output of the ignition system.

7 Claims, 3 Drawing Figures

WATER INJECTION SYSTEM FOR INTERNAL COMBUSTION ENGINES

BACKGROUND OF THE INVENTION

This invention relates generally to systems for delivering liquid to internal combustion engines; and more particularly concerns a water injection system characterized by simple design and effective performance over various stages in engine operation.

Water injection to the air intakes of internal combustion engines is recognized as providing certain benefits, such as reductions in detonation; ping and knock, and increased power. However, no prior water, alcohol or other liquid injection system of which I am aware has afforded the unusual simplicity of design and combinations of modes of operation, functions and improved results as are now provided by the present invention, these taking into consideration a wide range of engine operation conditions.

SUMMARY OF THE INVENTION

Basically, the control means now provided by the invention comprises a pulse rate frequency to analog converter for injecting water into the engine in direct proportion to ignition timing pulses of any internal combustion machine. That is to say, that all internal combustion spark ignition engines use a timed ignition system producing electrical pulses at a rate or frequency or that is in direct proportion to the engine R.P.M. This pulse rate frequency (P.R.F.) may be used to calibrate the flow of water being injected into the engine for any given R.P.M.

This is achieved in accordance with the invention by first conditioning the electrical pulses coming from the ignition system, removing the high voltage transients, noise and point bounce; then, using electronic circuits, a new pulse is generated maintaining the P.R.F. relationship of the original ignition system, but having a fixed amplitude and pulse width. This reconditioned pulse is used to charge a capacitor which develops a voltage across it in direct proportion to the P.R.F. (or R.P.M.), which furnishes voltage — RPM information to a comparator/amplifier combination. The latter will not "turn on" until the voltage — R.P.M. has reached a predetermined value. Once this preset value of voltage has been reached across the capacitor, the operational amplifier acts like a linear amplifier and drives a pass transistor. That transistor configuration will pass current from the battery directly to the water pump motor which results in water flow that is in direct proportion to the engine R.P.M. which results in a positive slope to the water vs. R.P.M. graph.

Basically, then, the invention is embodied in apparatus usable in combination with an internal combustion engine having an air intake and an ignition coil, the apparatus including a. a water supply system having an outlet communicable with said air intake, and b. means connected with said coil and with said system and including a pulse rate frequency to analog converter for controlling said system to increase said water supply to said outlet as a function of the frequency of the pulses produced by the said coil.

Additional objects include the provision of a vacuum switch that will pass current to a water pump drive only when manifold vacuum increases to a pre-set level, and circuitry that will provide a boost when the switch first closes.

These and other objects and advantages of the invention, as well as the details of an illustrative embodiment, will be more fully understood from the following description and drawings, in which:

DRAWING DESCRIPTION

DETAILED DESCRIPTION

Figure 1:
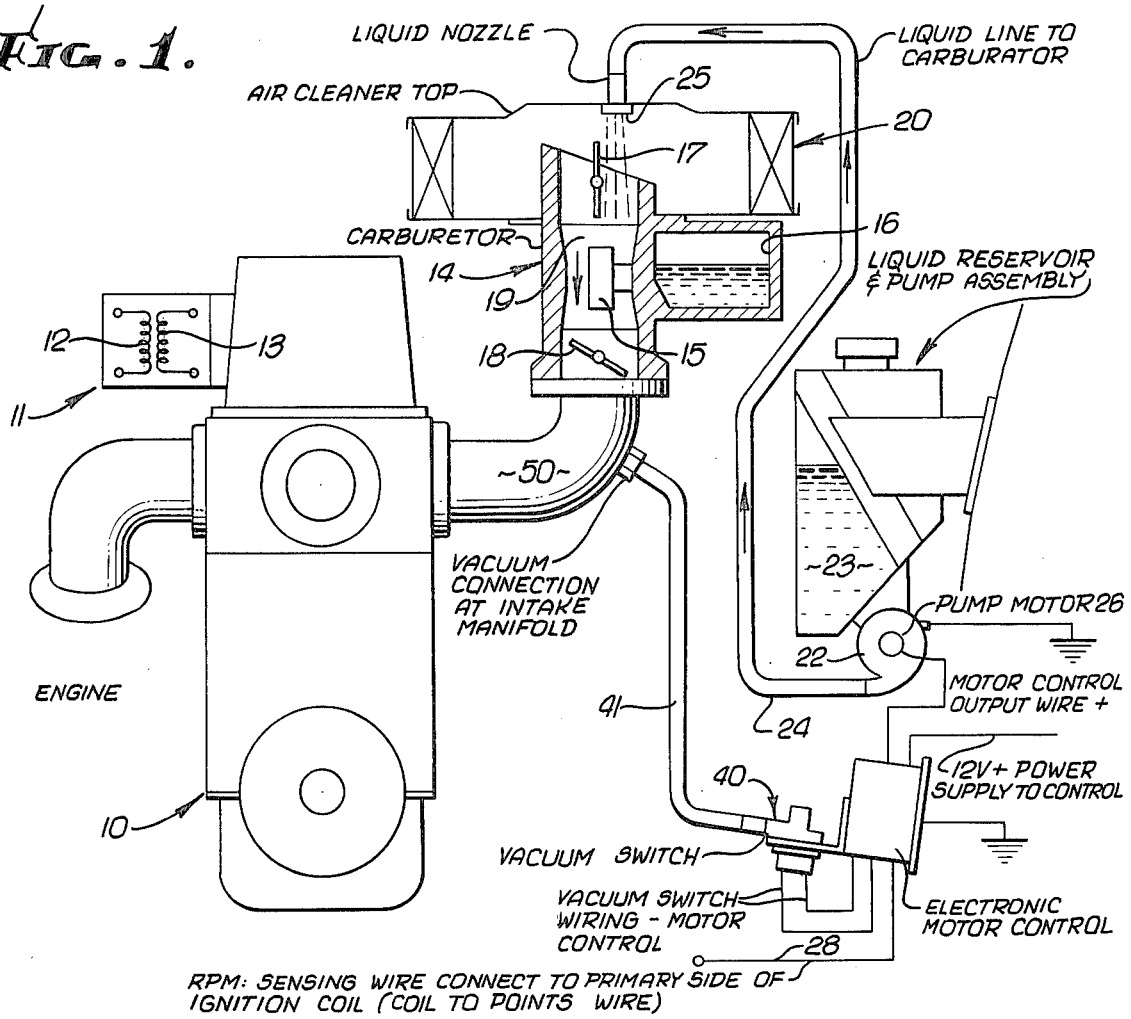
FIG. 1 is a drawing showing a system incorporating liquid injection apparatus.

In FIG. 1, an internal combustion engine 10 includes a conventional ignition system generally indicated at 11. The latter includes a coil having primary and secondary windings 12 and 13. Electrical pulses are produced in the windings as the distributor rotor rotates, the frequency of the pulses being proportional to engine R.P.M. The engine also includes a carburetor 14 having fuel supply jets 15 to which fuel is delivered from chamber 16. Butterfly (throttle and choke) valves are shown at 17 and 18 in the air intake passage 19, and they may be throttle controlled, in the conventional manner. An intake air cleaner appears at 20.

In accordance with the invention, liquid injection apparatus is provided to supply liquid, as for example water or other liquid, to the intake air, to aid the combustion process. The supply flow is metered as by a pump 22 taking suction from a liquid reservoir 23, and discharging to line 24 having a spray outlet 25 in communication with the intake air flow path. For example, outlet 25 may be located at or near the air cleaner, as shown, in proximity to air passage 19. The pump is driven by an electrical motor such as DC motor 26, whose speed is to be controlled as a function of engine speed or R.P.M.

Figure 2:
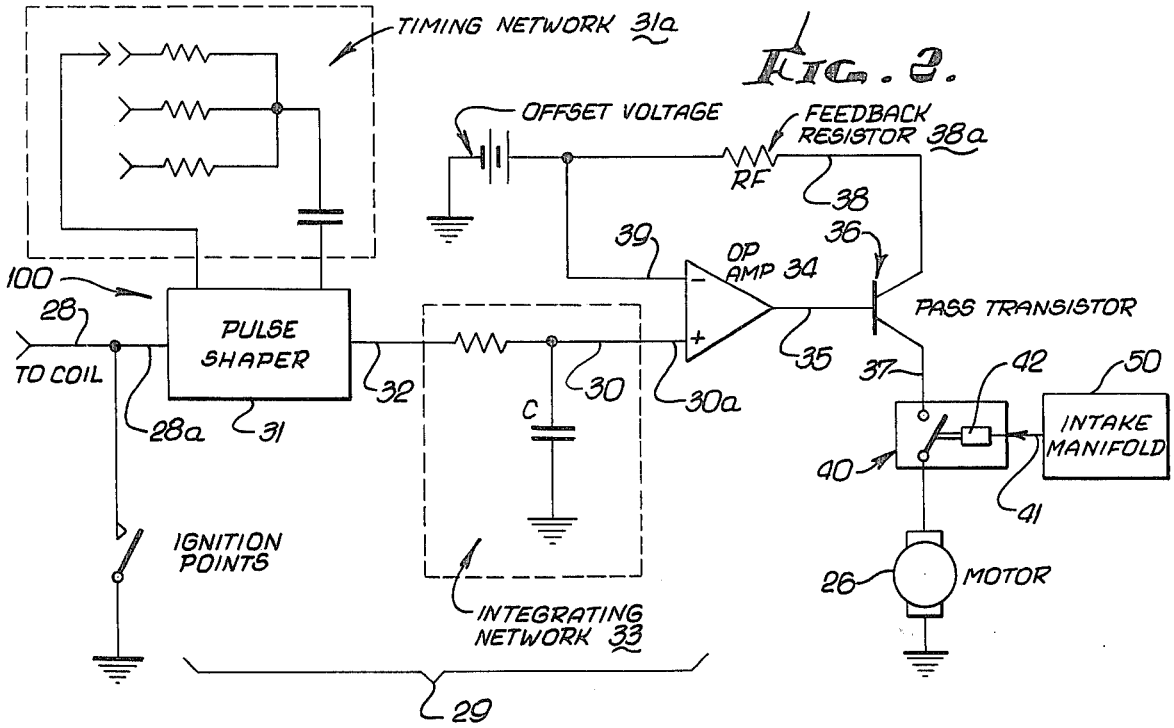
FIG. 2 is a block diagram showing control circuitry for the liquid injection apparatus.

Extending the description to FIG 2, the apparatus also includes control means 100 including a pulse rate frequency (PRF) to analog converter operable to control electrical current flow to the pump motor in response to and as a function of electrical pulses produced by the ignition system, whereby the supply of liquid or water delivered by pump 22 to the intake air will be a function of the pulse output of the ignition system. In this regard, the connection 28 to the primary coil 12 delivers such pulses at a frequency proportional to engine R.P.M. to circuitry 29 operable to produce a voltage at 30 which is a function of the pulse rate and also of engine R.P.M. For that purpose, circuitry 29 may advantageously include a pulse shaper 31 responsive to the pulse input at **28*a* to produce current pulses at output 32, and an integrating network at 33 connected to the shaper to integrate the current pulses and produce voltage at output 30. An integrating capacitor C may be used for this purpose. Note timing network 31*a* for the shaper 31** to adjust for 4, 6 or 8 cylinder engines, different resistors being used.

An operational amplifier 34 is responsive to that voltage at input **30*a* to provide corresponding drive current output at 35, an increase in P.R.F. resulting in an increase in drive current output supplied to the pump motor 26 via path 37. A "pass" type semiconductor 36 is connected as shown to pass drive current, and also to supply feedback current via loop 38 including resistor 38*a* to the operational amplifier input terminal 39. The connections are such that the resistor 38a** controls the gain of the feedback loop, thereby to establish the amount of change in liquid flow to the air intake in response to a given or unit change in P.R.F. This will also be further explained.

A vacuum controlled switch 40 is connected at 41 into the intake manifold 50 and senses engine load. When the pressure or vacuum in the intake manifold drops to about 4 inches of HG vacuum, the electrical circuit is complete, and at any time that the motor controller is producing voltage and the vacuum switch closes, current will flow to the motor and the pump begins to inject water into the carburetor and incoming airstream. These conditions of water injection typically exist under moderate to heavy vehicle engine loads such as acceleration, pulling a hill, or extremely high speed driving. A switch actuator is seen at 42.

The apparatus 100 is typically designed so that no output will be created below 2000 RPM engine speed. This prevents the inadvertent flow of water during starting modes, push starts etc. At 2000 engine RPM the circuit is closed and the motor controller delivers 6 volts with a linear increase in voltage up to 12 volts at 4000 RPM. Included in the circuitry is a feature that allows the motor controller to deliver 12 volts of power for approximately 330 milliseconds at any time the vacuum switch contacts are closed. This feature is used to bring the motor up to speed and give instant injection of the water at low voltages.

Figure 3:
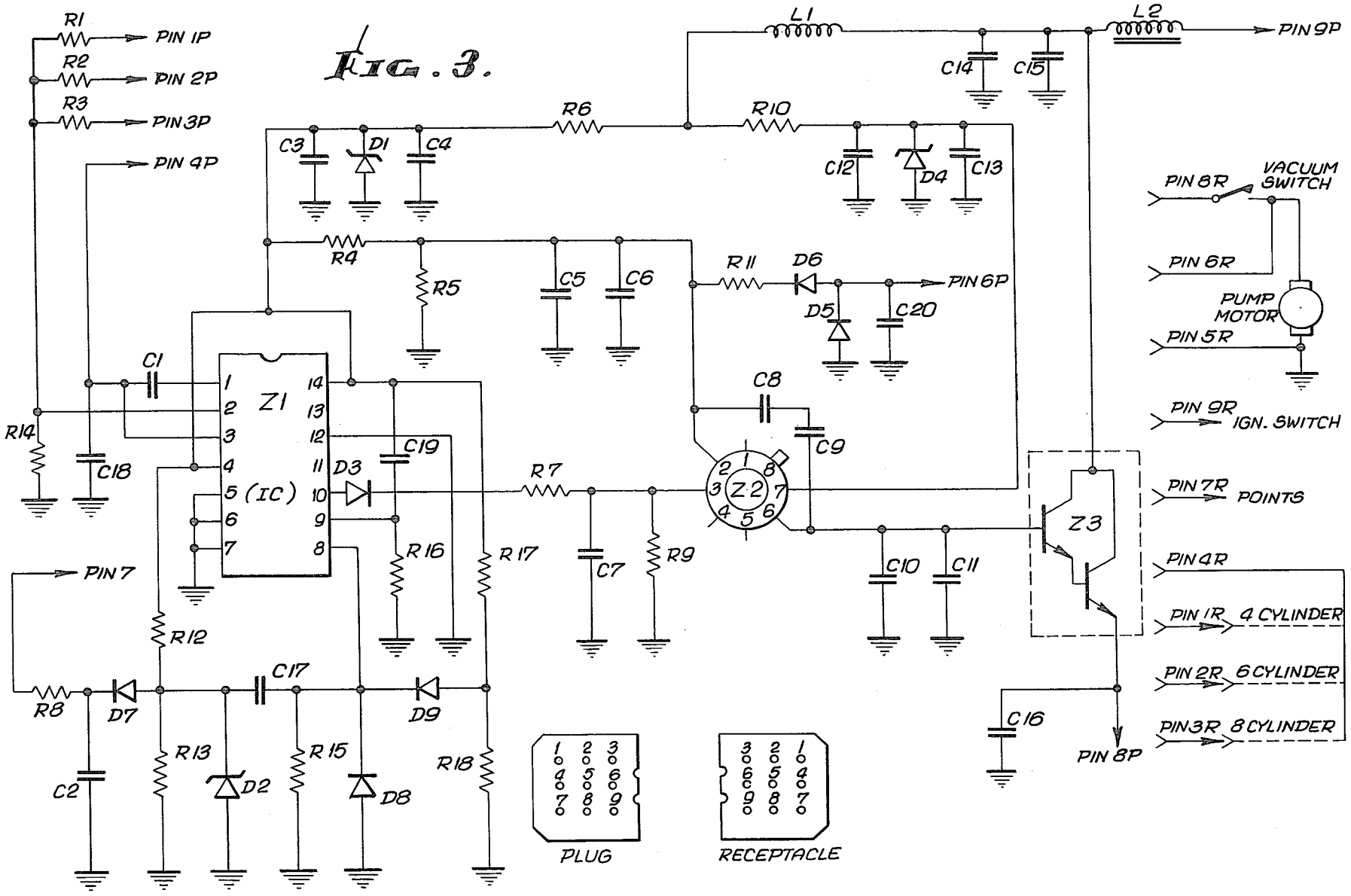
FIG. 3 is a detailed circuit diagram.

Reference will now be made to the detailed control circuitry of FIG. 3, corresponding to one preferred embodiment of FIG. 2, and the description will proceed by referring to three states of operation; as follows:

FIRST STAGE

This is accomplished by first conditioning the incoming pulses from the ignition system through the input circuit as follows: Resistor R8 in combination with Capacitor C2 form a low pass circuit. Diode D7 is used as an electronic switch, turning off when the signal level exceeds +6 volts peak, and R12 and R13 form the forward voltage bias network for D7 operation. D2 is used only to limit voltage excursion to +12VDC which occur as a result of D7 low switching speed unless a fast recovery diode is used, in which case D2 is not required. C17 is used for DC isolation and signal differentiation in combination with R15 and the internal resistance of Z1. D8 is used to protect Z1 from negative voltage transients. D9 blocks the signal path, but allows a DC bias level to be superimposed upon the AC signal at the input of Z1 so the proper trigger can be established. Pulses are now conditioned for use to Z1.

Integrated circuit (IC) Z1 is used as a positive edge-triggered monostable multivibrator with output pulse width independent of trigger pulse duration and is triggered by the positive edge of pulse coming from C17 and across R15. Capacitor C1, Resistor R1, R2, and R3 make up the RC timing components for this monostable operation and are chosen to give pulse width that results in the same R.M.S. voltage value for any given R.P.M. with the three different P.R.F. coming from a 4, 6 or 8 cylinder engine of 3.9, 2.7, 1.8 millisecond pulse width, respectively.

The output of this monostable multivibrator which is now standardized to both peak amplitude and pulse width, but still contains the original PRF information, is passed to the next network starting with D3. Diode D3 is used as a one way switch, letting the positive pulse transitions charge C7 and preventing Z1 from being a current sink discharging back through R7. Resistor R7 and C7 form a RC charging time constant of 72Ms, therefore requiring many pulses from Z1 to charge C7 completely. R9 is used to discharge C7 at a much longer rate of time, allowing C7 to integrate the imcoming pulse over a relatively long period of 352 milliseconds. The input resistance of Z2 is very high and is therefore not considered. Thus the incoming PRF has now been standardized and converted to an analog voltage that is in direct proportion to the PRF, and the circuit time constant is fast enough (352Mx) to follow the dynamic change in engine R.P.M.

SECOND STAGE

Z2 is used as a Linear Operational Amplifier and Comparator in this circuit configuration. R4 and R5 make up a voltage divider of 5 volts bias at pin 2 of Z2. C5 is used for voltage transients suppression. C6 and R11 are used in the feedback circuit which will be discussed later. When C7 has less than 5 volts across it, which is less than 2000 RPM, the voltage comparator action of Z2, voltage between pins 2 and 3, keeps pin 6 (its output) to within a few millivolts of ground reference. However, as the voltage across C7 passes through the 5 volt reference level established on pin 2 (greater than 2000 RPM) the comparator action of Z2 allows it to act like an amplifier swinging its output to within a few millivolts of the 12 volts power supply. In actual practice this won't always happen because of the feeback circuit, which will be discussed later. As the voltage swings positive or negative at the output of Z2, C8 and C9 provide integration of negative feedback, thus smoothing Z2 output voltage. C8 and C9 are placed back to back because of large capacity required and the small sized polarized capacitors being available. In this circuit configuration they have no polarity.

THIRD STAGE

IC Z2 drives transistor Z3, which is in a Pass-Darlington transistor configuration.

This type of transistor configuration is used because of its very high DC current gain of better than 750. This means that with Z2 limited current drive of a conservative 10 milliampers, it takes only 2.66 milliampers to drive a full two ampers through Z3, which is the full load current for the water pump motor.

Both C10 and C11 are used to suppress voltage transients that might get back to Z2 via the transistor diode junction from the power supply. The output of Z3 goes directly to the vacuum switch, motor, and ground return completing the circuit.

Feedback (voltage) information is taken from the motor side of the switch and is returned back to Z2 through R11 and D6. Diode D5 and C20 are used to suppress the voltage transient generated across the motor winding when the vacuum switch is opened. D6 is used to disconnect the feeback loop, when the voltage across C7 drops below 5 volts. R11 is used in combination with R4 and R5 to set the gain of the feedback loop and thus establish the positive slope of the line for voltage or water flow vs. R.P.M. The voltage at pin 2 of Z2 establishes the offset point. Therefore, in the equation for a straight line $Y = MX + b$ the slope $M$ is established by the gain of Z2 and Z3 combined with feedback. The offset point $b$ is established by the voltage at pin 2 of Z2. $X$ is the voltage across C7 or R.P.M. and $Y$ is the resultant calibrated water flow.

To overcome the inertia of the motor for fast start-up, the feedback circuit is attached to the motor side of the vacuum switch. Therefore, when the switch opens, the feedback returns to zero and allows Z2 to have a very high gain which results in its output voltage to swing to within a few millivolts of the 12 volts DC power supply driving Z3 to a full state and placing full power supply voltage across the vacuum switch. When the vacuum switch is closed, the full power supply is present across the motor and this voltage is allowed to decay to normal drive levels by the RC time constant action of R11 and C6 over a period of 330 milliseconds.

POWER SUPPLY

Inductor L1 in combination with C14 and C15 form a relatively high current, low pass filter for the motor and electronics. Inductor L1 is used as a low pass circuit for more RF isolation of the electronic circuits. R6 limits current flow to D1. C3 and C4 suppress voltage transients. D1 establishes the voltage level for Z1 and the three voltage dividers circuit. R10 limits current to D4, C12 and C13 are used to suppress voltage transients across D4. D4 establishes both the voltage level for Z2 and the upper drive voltage to Z3, thus limitng the voltage to the water pump motor at 10 VDC, establishing the upper end to the equation $MX + b$. R18 and C18 are used to limit voltage transients to the input of Z1.

I claim:

1. In liquid injection apparatus for use with an internal combustion engine having an ignition system and an air intake manifold, the combination comprising a. a liquid pump and electrical drive therefor, the drive including an electrical motor, the pump having an outlet communicable with the engine air intake, b. and control means including an electrical make or break switch and a pulse rate frequency to analog converter to control electrical current flow to the drive via said switch in response to and as a function of electrical pulses produced by said ignition system, whereby the flow of liquid to the engine air intake will be a function of the pulse output of the ignition system, the switch directly connected in series with the motor, c. there being a switch actuator connected with the switch, the actuator operatively connected with the engine air intake manifold to close the switch enabling said current flow to the drive when air pressure in the manifold drops to predetermined level, whereby said flow of liquid to the engine air intake will then be established, the switch, when open, blocking current supply to the motor, d. the control means including a semiconductor connected to pass drive current to the pump drive, and an operational amplifier connected between the converter and semiconductor to supply said drive current as a function of the voltage output of the converter, e. and an RC feedback loop connected between the motor side of the switch and the operational amplifier to be responsive to closing of the switch to allow the control means to provide a temporary increase in power supplied to the drive followed by a reduction in power supplied to the drive, whereby the device may be quickly brought up to speed for providing a rapid delivery of liquid to said outlet.

2. The combination of claim 1 wherein said converter includes circuitry responsive to the ignition pulse rate frequency to develop a voltage which is a function of said ignition pulse rate frequency.

3. The combination of claim 2 wherein said circuitry includes a pulse shaper responsive to said ignition pulses to produce current pulses.

4. The combination of claim 3 wherein said circuitry includes an integrating network connected to said shaper to produce said voltage as a function of said current pulses.

5. The combination of claim 4 including an engine ignition coil connected with said pulse shaper to supply said ignition pulses thereto.

6. The combination of claim 5 including said internal combustion engine having a carburetor, said pump outlet being in direct communication with said carburetor air intake.

7. The combination of claim 1 including a water supply connected with the pump intake.

* * * * *